US006235117B1

(12) United States Patent
McDonald

(10) Patent No.: US 6,235,117 B1
(45) Date of Patent: May 22, 2001

(54) SQUEEGEE ROLL FOR THIN SHEET HANDLING SYSTEM

(75) Inventor: Eamon P. McDonald, 24046 Fushia Ct., Murrieta, CA (US) 92562

(73) Assignees: Eamon P. McDonald, Murrieta; Seamus P. McDonald, Temecula, both of CA (US)

( * ) Notice: Subject to any disclaimer, the term of this patent is extended or adjusted under 35 U.S.C. 154(b) by 0 days.

(21) Appl. No.: 09/187,794

(22) Filed: Nov. 6, 1998

Related U.S. Application Data

(60) Provisional application No. 60/064,872, filed on Nov. 6, 1998.

(51) Int. Cl.[7] ..... B05C 3/09

(52) U.S. Cl. ..... 118/424; 118/407; 118/114; 118/121

(58) Field of Search ..... 118/302, DIG. 15, 118/424, 117, 114, 313, 325, 407, 121; 15/250.451, 3, 250.48, 100, 102; 396/614; 399/249; 134/65, 64 R; 492/6

(56) References Cited

U.S. PATENT DOCUMENTS 2,428,965 * 10/1947 Frisco et al. ..... 118/DIG. 15
4,143,969 * 3/1979 Oddo ..... 355/110
4,809,639 * 3/1989 Yasui et al. ..... 118/65
5,311,982 * 5/1994 Clopton ..... 198/779
5,720,813 * 2/1998 McDonald ..... 118/314
5,745,816 * 4/1998 Verlinden et al. ..... 396/614
5,746,234 5/1998 Jones .

* cited by examiner

*Primary Examiner*—Laura Edwards
(74) *Attorney, Agent, or Firm*—Akin, Gump, Strauss, Hauer & Feld, L.L.P.

(57) ABSTRACT

An apparatus for advancing, guiding, and processing flexible sheet members through a processing area in which fluid contacts the flexible sheet members is provided. The apparatus includes a roller conveyor which is adapted to convey the flexible sheet members to a processing module located along the roller conveyor. The processing module includes an entrance, an exit and a wet area in which fluid is provided to at least one surface of the flexible sheet members. At least one pair of squeegee rollers are located at one of the entrance and the exit to the wet area of the processing module to inhibit fluid leakage from the wet area. One squeegee roller is located on each side of the conveyor such that the flexible sheet members pass between a nip of the squeegee rollers. Each squeegee roller includes a rigid, hollow, outer tube and a light weight, open core located within the outer tube to provide a light weight squeegee roller.

5 Claims, 4 Drawing Sheets

SQUEEGEE ROLL FOR THIN SHEET HANDLING SYSTEM

CROSS-REFERENCE TO RELATED APPLICATIONS

This application claims the benefit of U.S. Provisional Application No. 60/064,872, filed Nov. 6, 1998.

BACKGROUND OF THE INVENTION

The present invention relates to equipment for handling, processing and cleaning thin panels, including highly flexible sheet members, and more particularly to an improved squeegee roll and squeegee roll arrangement for use in such a thin sheet handling system.

In the art of conveyorized fluidic processing of extremely thin articles, such as flexible electronic circuits, it is desirable not only to have a machine that both transports the thin articles from conveyor roller to conveyor roller with minimal damage and delivers fluid efficiently and effectively to its surface(s), but also to have such a machine whose parts are easily disassembled for maintenance purposes. This fluidic processing includes, among others, circuit feature etching, photo resist image developing, surface treatments and depositions, rinsing and drying.

When the fluid process incorporates delivering the fluid in streams as a sprayed liquid or ducted air over and/or under a conveyorized roller system with the axes of the rollers transverse the direction of desired article travel, it is necessary to mechanically support the thin articles from below and also often from above while attempting to minimize the interference such support tends to impart on the fluid streams. Without sufficient mechanical support, thin articles tend to buckle, wrinkle and/or jam in the conveyor system, causing unwanted machine downtime and loss of product. Towards such minimized interference, narrow rods with wheels are used for mechanical support, rather than solid cylindrical rollers. The spaces between the wheels are intended to allow for more free travel of the sprayed liquid to reach the surface of the article. Often an opposing set of upper rods and wheels are used to keep the articles from lifting and/or buckling.

On either side of the wet area, pairs of squeegee rolls are typically utilized to prevent the processing fluid from dragging out with the thin articles being processed. Such rollers have generally been constructed of a solid core, made of polyvinyl chloride, stainless steel, or titanium, coated with rubber, with each roller weighing eight or more pounds. In the prior known systems, generally only a single pair of upper and lower squeegee rolls was required to contact the thin article as it was carried into and out of the wet area to prevent the processing fluid from escaping. However, in newer high volume systems, such as the RAMJET system which is available from Advanced Chemill Systems, Inc., which was invented by the present inventor and is described in U.S. Pat. No. 5,720,813, which is incorporated herein by reference as if fully set forth, more processing fluid is provided in the wet area at higher pressure, and the processing area is shorter. In order to prevent drag out of processing fluid, multiple pairs of squeegee rollers are required along the conveyor path entering and exiting the wet area. While it is possible to use the known squeegee rollers, this would require a more powerful drive system, and the heavy weight of the known rollers creates more wear on the drive gears typically used.

It is also desirable to provide supports on at least the exit side of squeegee rollers in order to prevent thin articles, such as films of material, from wrapping around the squeegee roller due to the surface tension of the processing fluid on the squeegee roller and the article. Typically grooves are provided in the squeegee roller for the known supports, which take the form of clips. However, such grooves provide an escape path for the processing fluid from the wet section of the equipment because of the loose tolerances required between the clips and the rubber jacketed squeegee roller in order to prevent the rubber from gripping and damaging the clip.

SUMMARY OF THE INVENTION

Briefly stated, the present invention provides an apparatus for advancing, guiding, and processing flexible sheet members through a processing area in which fluid contacts the flexible sheet members. The apparatus includes a roller conveyor which is adapted to convey the flexible sheet members to a processing module located along the roller conveyor. The processing module includes an entrance, an exit and a wet area in which fluid is provided to at least one surface of the flexible sheet members. At least one pair of squeegee rollers are located at one of the entrance and the exit to the wet area of the processing module. One squeegee roller is located on each side of the conveyor such that the flexible sheet members pass between a nip of the squeegee rollers. Each squeegee roller includes a rigid, hollow, outer tube and a light weight, open stiffening core located within the outer tube to provide a light weight squeegee roller.

In another aspect, the present invention provides an improved squeegee roller for an apparatus for advancing, guiding, and processing flexible sheet members through a processing area in which fluid contacts the flexible sheet members. The improved squeegee roller includes a hollow, outer tube comprised of a polymeric material. The outer tube has a first end and a second end. A light weight, open core is located within the outer tube. An end plug having a stub shaft is sealingly located in each of the first and second ends. The end plugs are made of a polymeric material and are fused or welded to the outer tube, sealing the core within the outer tube.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
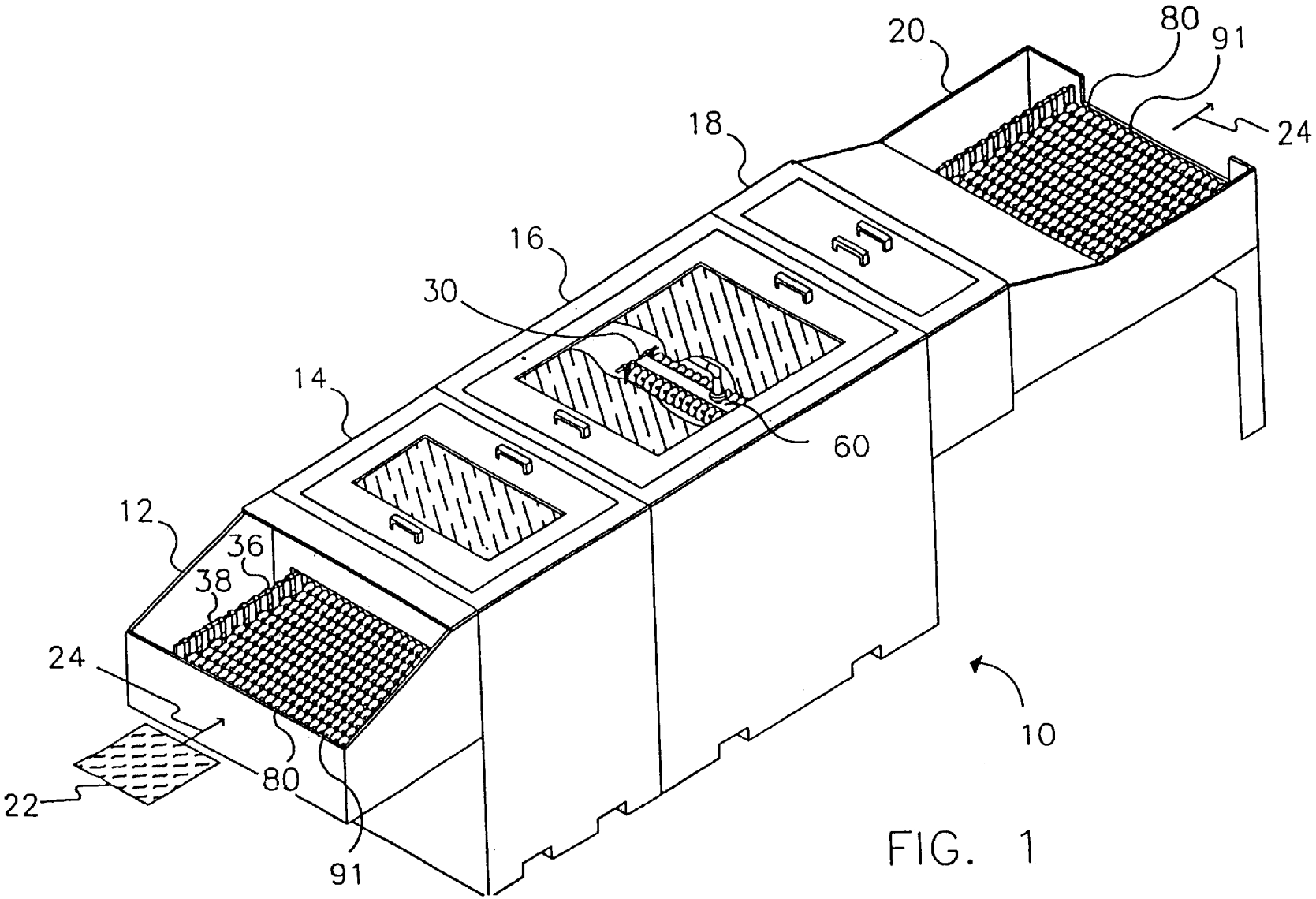
FIG. 1 is a generalized depiction of a conveyorized processing machine incorporating the improved squeegee rolls of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the conveyorized processing machine 10, and designated parts thereof. The terminology includes the words specifically mentioned above, derivatives thereof and words of similar import.

Figure 2:
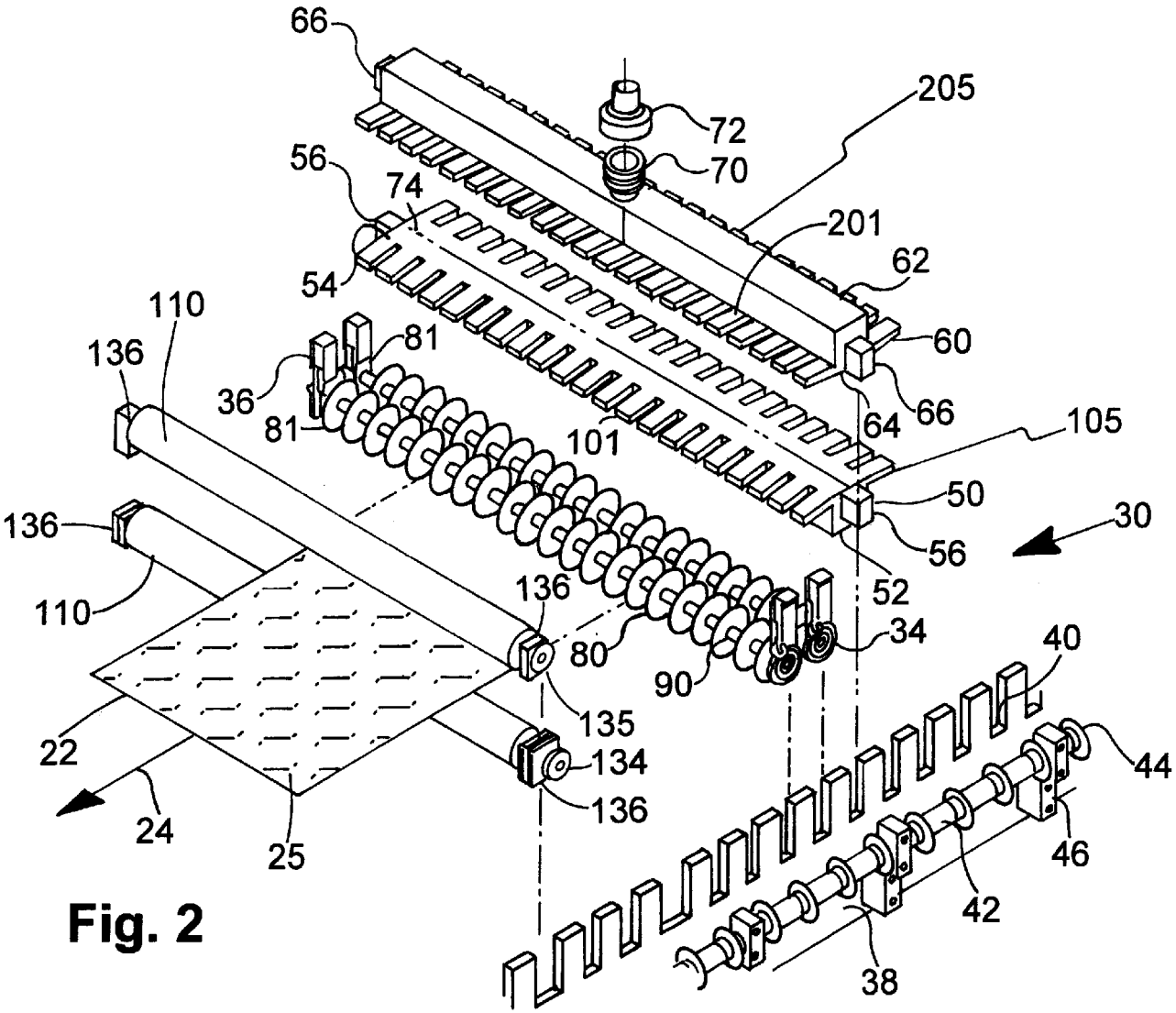
FIG. 2 is an exploded view of the apparatus and a portion of the machine in FIG. 1 showing the wet area and the exit side squeegee rolls.

The present invention is directed to an apparatus that is particularly useful for advancing, guiding, and processing highly flexible sheet members. With reference to FIGS. 1–2 of the drawings, FIG. 1 depicts a general representation of a conveyorized processing machine 10, with an input module 12, a first processing module 14, a second processing module 16, a drying module 18 and an output module 20. A flexible panel 22 is transported along a feed path 24 on a conveyor 91. Each of the modules 12 through 20 serve to transport the flexible panel 22, while the modules 14 through 18 additionally deliver at least one processing fluid (liquid or gaseous) to at least one surface of the flexible panel 22, and are separable from each other for addition or subtraction of processes to the machine 10. The processing fluids which are applied can include, but are not limited to, processes such as photo resist developing, etching, through-hole treatment, plating, rinsing, surface treatment, anti-tarnish, drying and the like.

The flexible panel 22 can be a flexible circuit member, such as plated and/or etched copper lines on polyamide, epoxy-glass laminate or kapton, but might also be other thin, flexible articles which are to be processed, such as shadow masks, photographic films, thin glass sheets, or etc. Fluid delivery is achieved by the means of pumps, blowers, and the like (not shown), and in the case of liquid process fluids, is usually recirculated from a tank or sump within each module. The materials of construction for each of the modules in the machine 10 are compatible with their respective processing fluids and can include for example, polyvinyl chloride (PVC), chloro-polyvinyl chloride (CPVC), titanium, stainless steel, kynar, polypropylene, polycarbonate (Lexan) and/or tempered glass.

According to the present invention, the machine 10 is provided with one or more processing apparatus 30, one such apparatus 30 being located in the second processing module 16. It is contemplated that counterparts of the apparatus 30 may be utilized in the first processing module 14 and the drying module 18. With particular reference to FIG. 2, the apparatus 30 is shown in relation to the conveyor 91 internal to a fluid process module in the processing machine 10, looking from the back side of the view shown in FIG. 1. A pair of conveyor rails 38 for the preferred embodiment provide rotational support for both a drive shaft 42 (supported by one of the rails 38 only, by means of a plurality of drive shaft bearing blocks 46), and also for a plurality of lower roller shafts 90 (by means of a plurality of roller shaft bearing blocks 36). One or more drive motors (not shown) rotate(s) the drive shaft 42 and a plurality of drive shaft gears 44 located along the drive shaft 42, which are engaged with and turn a plurality of roller shaft gears 34, which are connected to and turn the lower roller shafts 90 each with a plurality of lower rollers 80, which engage the flexible panel 22 for transport along the feed path 24. In the preferred embodiment, the rails 38 are machined from ½ thick PVC, CPVC or polypropylene plastic.

In the preferred embodiment, a lower fluid delivery device 50 with an integral fluid chamber 52, an integral lower platen member 54 having a platen surface 55, and a pair of lower mounting blocks 56 (on both ends) is provided. The platen member 54 has a plurality of fluid ports 74 formed therein for directing pressurized fluid to at least a lower surface 23 of the flexible panel 22.

An optional upper fluid delivery device 60 with an integral upper fluid chamber 62, an upper platen member 64 (having a platen surface 65) and upper mounting blocks 66 has counterparts of the fluid ports 74 (hidden from view in FIG. 2) for directing pressurized fluid to at least an upper surface 25 of the flexible panel 22. Both of the fluid delivery devices 50 and 60 have at least one inlet 70 (shown only for the upper device 60) attached by a plumbing union 72 for receiving processing fluid from the aforementioned pumps or blowers. The fluid ports 74, the union 72, and the inlet 70 are not necessarily identical for the devices 50 and 60, nor are the ports 74 necessarily identical within the devices 50 or 60. However, it will be recognized by those skilled in the art from the present disclosure that other types of fluid delivery manifolds, csuch as a perforated pipe segment could be utilized, if desired.

The conveyor 91 includes a plurality of roller assemblies 81 which each consist of one of the roller shafts 80, two of the roller shaft bearing blocks 36, one of the roller shaft gears 34, and one or more of the lower rollers 80. The preferred embodiment optionally allows for an upper roller shaft 190 (each with a plurality of upper rollers 180) which can slide into grooves (not shown) in the roller shaft bearing blocks 36, in order to maintain the flexible panel 22 within the desired feed path. The upper roller shafts 190 and their rollers 180 can slide freely up and down in the grooves in the roller bearing blocks 36 during operation and for removal, and each assembly 81 can be removed as a unit. Also in the preferred embodiment, the lower rollers 80 are 2.25 inches in diameter and approximately ⅛ in. thick, and the roller assemblies 81 are spaced on a two-inch longitudinal pitch along the conveyor 91. Alternatively, the lower rollers 80 can be much thicker, and can comprise a substantial portion of the width of the conveyor.

Materials of construction for the rollers 80 and 180 can include EPDM, polypropylene, or other material which is resistant to decomposition under the desired operating conditions. The preferred embodiment also includes perforations (not shown) within each of the rollers 80 and 180 to allow lighter weight and/or to minimize the blockage of fluid flow in a transverse direction. The roller shafts 90 and 190 for the preferred embodiment are constructed of epoxy-coated 0.375 inch diameter fiberglass rods, and the bearing blocks 36 and 46, along with the gears 34 and 44, are molded polypropylene. For most uses of the fluid delivery devices 50 and 60, a preferred material is extruded PVC. The fluid delivery device 50 is extruded in one piece along with a lower forward wing portion 100 and a lower rearward wing portion 104 (both attached to the lower device 50). Similarly, the fluid delivery device 60 is extruded in one piece along with an upper forward wing portion 200 and an upper rearward wing portion 204 (both attached to the upper device 60), which wing portions 100, 104, 200 and 204 are then subsequently machined to create a plurality on each wing of spaced segments 101, 105, 201 and 205, respectively. Dispersion plates (not shown) may be included within the chambers 52 and/or 62 to help uniformly distribute the fluid pressure among the fluid ports 74. End plugs which include, the respective mounting blocks 56 and 66 are glued in to seal the ends of fluid chambers 52 and 62, respectively.

With further reference to FIG. 2, access to areas above or below the conveyor 91 for maintenance purposes is facilitated by sliding the roller assemblies 81 out of one of a plurality of conveyor rail slots 40 in the conveyor rails 38. similarly, one or both of the fluid delivery devices 50 and 60 may be removed by sliding the respective mounting blocks 56 and 66 out of the conveyor rail slots 40 and by undoing the plumbing unions 72. This aspect of simple removal of the fluid delivery devices 50 and/or 60 is one of the useful advantages of the present apparatus, while still maintaining support of the flexible panels 22 as they are being transported during operation, as further described below. Although just one configuration of simple, independent removal of the fluid delivery devices 50 and 60 has been disclosed in detail, other configurations can be used (such as using flexible hoses with hose clamps in place of rigid plumbing with the plumbing unions 72 or releasable clamps and brackets in place of slidable roller shaft bearing blocks 36) to allow for the desired removability, and need not be exhaustively described. described.

As shown in FIG. 2, preferably at least one pair of squeegee rollers 110 is provided at least at one of the entrance and exit to the wet area of the processing module 16. Only one pair of squeegee rollers 110 has been shown at the exit area of the processing module 16 along the path of conveyor 91. However, it will be recognized by those skilled in the art that one or more pairs of squeegee rollers 110 could be at both the entrance and/or the exit to the processing module 16, and that multiple pairs of squeegee rollers 110 can be used at the entrance and/or exit of the processing module 16, depending upon the particular application. One squeegee roller 110 is located on each side of the conveyor 91 such that the flexible sheet member 22 passes between a nip of the squeegee rollers 110.

As shown in FIG. 2, the squeegee rollers 110 are supported by bearing blocks 136, similar to the roller shaft bearing blocks 36. This arrangement allows the upper squeegee roller 110 to float relative to the lower squeegee roller 110 to accommodate flexible panels 22 of different thicknesses. A drive gear 134 is connected to the lower squeegee roller 110 and is driven by the drive shaft 42 via gears 44 in a similar manner to the lower roller assemblies 81. Preferably, the upper squeegee roller 110 also includes a drive gear 135 which intermeshes with the drive gear 134 on the lower squeegee roller 110 so that both the upper and lower squeegee rollers 110 are driven.

Figure 4:
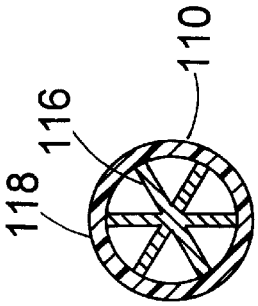
FIG. 4 is a cross-sectional view taken along lines 4—4 in FIG. 3.
Figure 3:
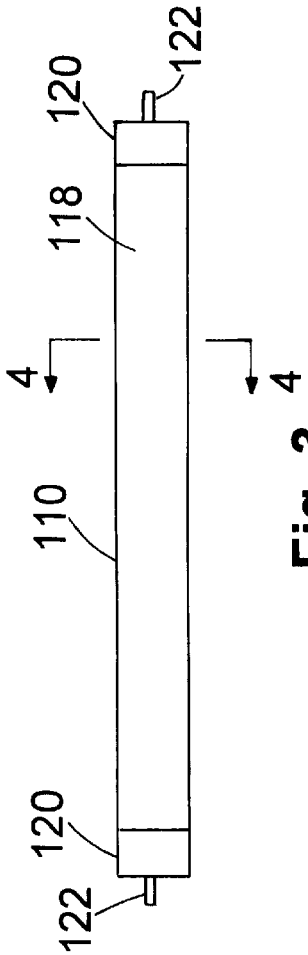
FIG. 3 is an elevational view of a squeegee roller in accordance with the present invention.
Figure 5:
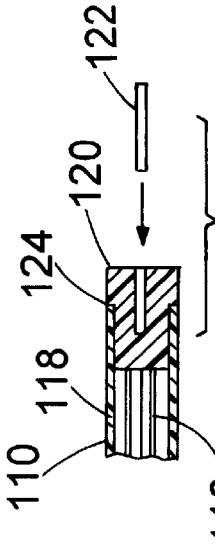
FIG. 5 is a cross-sectional view of one end of the squeegee roller shown in FIG. 3 which shows the attachment of an end plug.

Preferably multiple pairs of squeegee rollers 110 are located at at least one of the entrance and the exit of the processing module 16 in order to prevent processing fluid from escaping through a single pair of squeegee rollers 110. In such systems, it is desirable to reduce the weight of the rollers in order to minimize the load on the drive components, including the drive shaft 42, as well as to reduce the amount of energy required for driving the squeegee rollers 110. As shown in FIGS. 3–5, preferably each squeegee roller 110 includes a light weight, open core 116 which is located inside an outer tube 118. The core 116 is preferably extruded aluminum and includes a plurality of support legs which extend radially outwardly from a central hub to the internal diameter of the outer tube 118. However, it will be recognized by those skilled in the art from the present disclosure that the core 116 can be made from any other material having the desired strength and stiffness requirements to maintain the roller 110 generally straight and true, and preferably which will be stable even at elevated processing temperatures, depending on the particular application. The shape of the core 116 can be varied from the preferred hub and spoke arrangement to any other open (non-solid) light weight arrangement which would provide support for the outer tube 118, such as a hollow center portion with legs projecting outwardly from the center portion. Additionally, in the preferred hub and spoke arrangement, the number of spokes or support legs can be varied.

In the preferred embodiment, the outer tube 118 is made of a polymeric material, such as polypropylene, and preferably has an internal diameter of 1.70 inches and a finished external diameter of 2.25 inches. Preferably, the outside diameter is initially larger than the finished outside diameter, and the squeegee roller 110 is turned after assembly to obtain a true outer surface relative to the axis of the roller 110. It will be recognized by those skilled in the art from the present disclosure that the size of the core 116 and the outer tube 118 could be varied as desired, depending on the particular application. It will be similarly recognized that the outer tube 118 could be made of any suitable material which is resistant to the processing fluid, although polypropylene is preferred due to its resistance to the processing fluids used in connection with the processing module 16 of the present invention.

As shown in detail in FIG. 5, preferably the core 116 has a shorter length than the length of the outer tube 118 in order to allow end plugs 120 which support stub shafts 122 to be installed in the ends of the outer tube 118. The end plugs 120 are preferably made from polypropylene and are fused or welded to the ends of the outer tube 118 along seams 124 in order to seal the core 116 within the roller 110 so that it does not come in contact with the processing fluid. This eliminates the potential for corrosion or reaction between the core 116 and the processing fluid. The weld is preferably trued and smoothed during the turning process noted above to size and true the outer surface of the outer tube 118 after assembly of each roller 110. However, it will be recognized that other means can be used to connect the end plugs 120 into the ends of the outer tube 118, such as solvent welding, an adhesive, or a mechanical fit, such as a threaded connection.

Preferably, the stub shafts 122 are then assembled with the bearing blocks 136, and drive gears 134, 135 are connected to the drive ends of the squeegee rollers 110. However, depending upon the particular application, the upper squeegee roller 110 does not need to be driven and the upper gear 135 can be omitted.

The squeegee roller 110 in accordance with the present invention can be made to any desired length and has a weight which is less than 25% of the weight of the prior known rollers of an equivalent size. For a 32 inch roller in accordance with the present invention, the weight is approximately 1.5 pounds, as compared to eight (8) pounds for an equivalent solid roller with a rubber coating.

Figure 7:
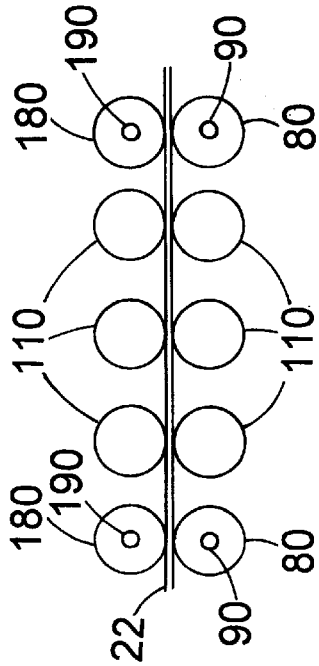
FIG. 7 is a schematic cross-sectional view showing the arrangement of three pairs of squeegee rollers located along the transport path with roller assemblies for transporting the flexible sheet being located on either side of the squeegee rollers.

In one preferred application, three sets of squeegee rollers 110 are used at the entrance and/or exit of the wet area, as shown schematically in cross section in FIG. 7, in order to prevent drag out of the processing fluid. This is especially useful for high fluid volume processing modules where a substantial volume of liquid is delivered to the surfaces of the flexible panel 22.

Figure 6:
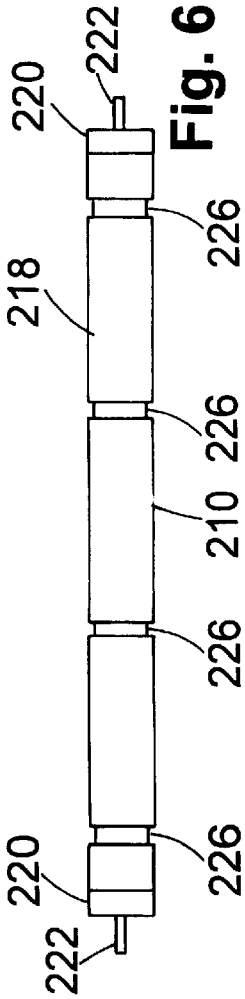
FIG. 6 is an elevational view of a second embodiment of a squeegee roller in accordance with the present invention.

Referring now to FIG. 6, a squeegee roller 210 with an externally grooved outer tube 218 is shown. The squeegee roller 210 is similar to the squeegee roller 110, and similar reference numbers which are greater by 100 have been provided to describe similar roller components. For example, the outer tube 218 of the squeegee roller 210 is similar to the outer tube 118 of the squeegee roller 110. Accordingly, these similar elements have not been described in detail for the sake of convenience.

The grooves 226 in the outer tube 218 are provided in order to allow support clips 228 (shown in FIG. 8) to be attached to the squeegee roller 210 in order to prevent the flexible panel 22 from wrapping around the squeegee roller 210 due to surface tension of the processing fluid acting on the flexible panel 22 and the roller 210 as the flexible panel 22 is being transported. Each groove 226 has sidewalls separated by a width, and the support clips 228 have a complementary width to provide sliding contact with the groove side walls to inhibit fluid from passing outside the wet area through the grooves 226.

Figure 8:
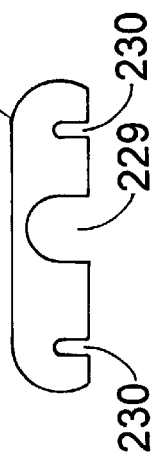
FIG. 8 is an elevational view of a support clip which is used in connection with the squeegee roller shown in FIG. 6.
Figure 10:
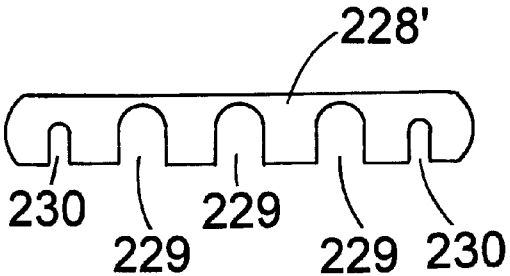
FIG. 10 is an elevational view of the support clip of FIG. 9.
Figure 9:
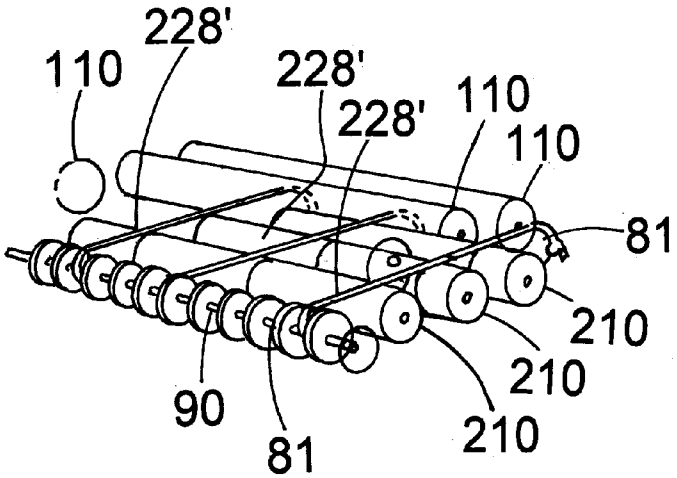
FIG. 9 is a perspective view of an arrangement of squeegee rollers located at the entrance and/or exit of a processing unit with support clips located on the lower squeegee rollers.

As shown in FIG. 8, the support clip 228 includes a circular cutout 229 which nests over the groove 226 in the squeegee roller 210 such that the surface of the support clip 228 is flush with the contact area or nip of the roller 210. The support clip 228 can span more than one squeegee roller 210 by extending the length of the support clip in the direction of travel of the conveyor path and providing multiple cutouts 229 to scat in aligned grooves in adjacent squeegee rollers 210 (as shown in FIGS. 9 and 10, described below). The support clip 228 extends past the one or more squeegee rollers 210 to the next adjacent roller shafts 90. Cutouts 230 are provided in the support clip 228 which allow the support clip 228 to be inserted over the roller shafts 90 in order to maintain the support clip 228 in position and provide a smooth transition from the roller assemblies 81 to the squeegee roller(s) 210.

In the preferred embodiment, the grooves 226 are only slightly wider than the thickness of the support clip 228 in order to prevent the processing fluid from escaping through gap between the grooves 226 and the support clips 228. Preferably, the grooves 226 are approximately 0.503 inches wide, and the support clips 228 are 0.500 inches wide. The support clip 228 is preferably made of polyethylene which has extremely low friction against the polypropylene outer tube 218 in order to allow the squeegee roller 210 to rotate within the support clip 228. It will be recognized by those skilled in the art that other materials may be used for the support clip 228 which have compatible properties with the processing fluid, and which have a low coefficient of friction with the material of the outer tube 218. This solves the problem in the known squeegee roller devices which use rubber coated rollers with large grooves or a spaced plurality of roller segments on a central shaft, with the grooves or spaces being much wider than the thickness of the support clips in order to prevent binding.

While in one preferred embodiment shown in FIG. 6, four grooves 226 are shown, those skilled in the art will recognize from the present disclosure that the number of grooves 226 and support clips 228 may be varied to suit a particular application. For example, if a processing unit 16 is only designed to handle one size of flexible sheet 22, it may be possible to use only two grooves 226 and two support clips 228 to ensure that the flexible sheet 22 does not become wrapped around a squeegee roller 210. However, for processing equipment designed to handle multiple sizes of flexible sheets 22, it would be desirable to provide grooves 226 and support clips 228 at a determined minimum spacing in order to prevent an undersized flexible sheet 22 from wrapping around a squeegee roller 210 and becoming jammed.

Referring now to FIG. 9, an arrangement of three pairs of squeegee rollers is shown. Each pair of squeegee rollers includes an upper roller 110 without grooves and a lower roller 210 with grooves. Modified support clips 228' (shown in detail in FIG. 10) are provided in order to prevent the flexible sheet 22 from wrapping around the lower squeegee rollers 210. The support clips 228' include three cutouts 229 which are adapted to fit around the grooves 226 in the squeegee rollers 210, and two cutouts 230 which fit over the shafts 90 of the roller assemblies 81. It will be recognized by those skilled in the art from the present invention that the upper rollers could also be the grooved rollers 210, and that squeegee clips 228, 228' could be located between the upper squeegee rollers, if desired. The squeegee rollers 210, 110 and the roller assemblies 81 are preferably supported in the same manner as noted above.

Other arrangements using one or more pairs of the inventive squeegee rollers of the present invention can be made which would still fall within the scope of the present invention, and the preferred embodiments described above are meant only to be illustrative and not limiting.

It will be appreciated by those skilled in the art that changes could be made to the embodiment described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An apparatus for advancing, guiding, and processing flexible sheet members through a processing area in which fluid contacts the flexible sheet members, comprising:

a roller conveyor adapted to convey the flexible sheet members;

a processing module located along the roller conveyor having an entrance, an exit and a wet area in which fluid is provided to at least one surface of the flexible sheet members;

at least one pair of squeegee rollers located at one of the entrance and the exit to the wet area of the processing module, one squeegee roller being located on each side of the conveyor such that the flexible sheet members pass between a nip of the squeegee rollers, each squeegee roller including a rigid, hollow, outer tube and a light weight, open stiffening core located within the outer tube to provide a light weight squeegee roller, the outer tube including at least two grooves; and support clips connected to the squeegee roller in the grooves to prevent the flexible sheet member from wrapping around the squeegee roller due to surface tension of the fluid acting on the flexible sheet member and the roller as the flexible sheet member is transported along the roller conveyor.

2. An apparatus for advancing, guiding, and processing flexible sheet members through a processing area in which fluid contacts the flexible sheet members, comprising:

a roller conveyor adapted to convey the flexible sheet members;

a processing module located along the roller conveyor having an entrance, an exit and a wet area in which fluid is provided to at least one surface of the flexible sheet members;

at least one pair of squeegee rollers located at one of the entrance and the exit to the wet area of the processing module, one squeegee roller being located on each side of the conveyor such that the flexible sheet members pass between a nip of the squeegee rollers, each squeegee roller including a rigid, hollow, outer tube and a light weight, open stiffening core located within the outer tube to provide a light weight squeegee roller, the outer tube including at least two grooves, each groove having side walls separated by a width; and support clips connected to the squeegee roller in the grooves to prevent the flexible sheet member from wrapping around the squeegee roller due to surface tension of the fluid acting on the flexible sheet member and the roller as the flexible sheet member is transported along the roller conveyor, the support clips having a width complementary to the width of the separated side walls to provide sliding contact with the side walls of the grooves to inhibit fluid from passing outside the wet area through the grooves.

3. The apparatus of claim 2 wherein the apparatus has multiple pairs of squeegee rollers located at at least one of the entrance and the exit to the wet area and the support clips span more than one squeegee roller.

4. The apparatus of claim 2 wherein the outer tube is made of polypropylene and the support clips are made of polyethylene having low friction against the polypropylene outer tube.

5. An apparatus for advancing, guiding, and processing flexible sheet members through a processing area in which fluid contacts the flexible sheet members, comprising:

a roller conveyor adapted to convey the flexible sheet members;

a processing module located along the roller conveyor having an entrance, an exit and a wet area in which fluid is provided to at least one surface of the flexible sheet members;

a least one pair of squeegee rollers located at one of the entrance and the exit to the wet area of the processing module, one squeegee roller being located on each side of the conveyor such that the flexible sheet members pass between a nip of the squeegee rollers, at least one of the squeegee rollers having at least two grooves; and support clips connected to the squeegee roller in the grooves to prevent the flexible sheet member from wrapping around the squeegee roller due to surface tension of the fluid acting on the flexible sheet member and the roller as the flexible sheet member is transported along the roller conveyor, a surface of the support clips being positioned substantially flush with the nip of the squeegee rollers.

* * * * *